US012703961B2

(12) United States Patent
Morikawa et al.

(10) Patent No.: US 12,703,961 B2
(45) Date of Patent: Aug. 11, 2026

(54) WORK MACHINE

(71) Applicant: HITACHI CONSTRUCTION MACHINERY CO., LTD., Tokyo (JP)

(72) Inventors: Masatoshi Morikawa, Ushiku (JP); Shinji Nishikawa, Kasumigaura (JP); Hiroaki Tanaka, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 309 days.

(21) Appl. No.: 18/022,324

(22) PCT Filed: Nov. 10, 2021

(86) PCT No.: PCT/JP2021/041423
§ 371 (c)(1),
(2) Date: Feb. 21, 2023

(87) PCT Pub. No.: WO2022/208974
PCT Pub. Date: Oct. 6, 2022

(65) Prior Publication Data

US 2023/0349129 A1 Nov. 2, 2023

(30) Foreign Application Priority Data

Mar. 29, 2021 (JP) ..... 2021-056108

(51) Int. Cl.
*E02F 9/20* (2006.01)
*E02F 3/43* (2006.01)
(Continued)

(52) U.S. Cl.
CPC ..... *E02F 9/2033* (2013.01); *E02F 9/24* (2013.01); *E02F 9/262* (2013.01); *E02F 3/435* (2013.01)

(58) Field of Classification Search
CPC . E02F 9/2033; E02F 9/24; E02F 9/262; E02F 3/435
See application file for complete search history.

(56) References Cited

U.S. PATENT DOCUMENTS 10,072,395 B2 * 9/2018 Tsukamoto ..... E02F 9/2033
2018/0058033 A1 * 3/2018 Higuchi ..... E02F 9/16
(Continued)

FOREIGN PATENT DOCUMENTS

JP 02-308018 A 12/1990
JP 04-136324 A 5/1992
(Continued)

OTHER PUBLICATIONS

International Preliminary Report on Patentability received in corresponding International Application No. PCT/JP2021/041423 dated Oct. 12, 2023.
(Continued)

*Primary Examiner* — Anne Marie Antonucci
*Assistant Examiner* — Luis G Del Valle
(74) *Attorney, Agent, or Firm* — MATTINGLY & MALUR, PC

(57) ABSTRACT

A main controller of a work machine computes target position information of an entry-prohibited area plane on the basis of operation information of a console switch 11 or a monitor operation device, decides, on the basis of the target position information of the entry-prohibited area plane, whether or not a distance r1 between a target position M of the entry-prohibited area plane and the center O of swing action of an upper swing structure is greater than a threshold value set based on a distance r2 from the center O of swing action of the upper swing structure to a rear end of the upper swing structure, validates the target position information of the entry-prohibited area plane when the distance r1 is
(Continued)

greater than the threshold value, and sets the entry-prohibited area plane at the target position M.

4 Claims, 16 Drawing Sheets

(51) Int. Cl.
*E02F 9/24* (2006.01)
*E02F 9/26* (2006.01)

(56) References Cited

U.S. PATENT DOCUMENTS

| | | | | |
|---|---|---|---|---|
| 2019/0249391 | A1* | 8/2019 | Kikuchi | E02F 3/845 |
| 2021/0230837 | A1 | 7/2021 | Narikawa et al. | |
| 2021/0230841 | A1* | 7/2021 | Kurosawa | E02F 9/2033 |

FOREIGN PATENT DOCUMENTS

| | | | |
|---|---|---|---|
| JP | 2011-52383 | A | 3/2011 |
| JP | 2020-041388 | A | 3/2020 |
| JP | 2020-143449 | A | 9/2020 |

OTHER PUBLICATIONS

International Search Report of PCT/JP2021/041423 dated Feb. 1, 2022.
Chinese Office Action received in corresponding Chinese Application No. 202180051483.6 dated Jun. 3, 2025.

* cited by examiner

WORK MACHINE

TECHNICAL FIELD

The present invention relates to a work machine such as a hydraulic excavator or a hydraulic crane to which an entry-prohibited area for a work implement is set to perform a work.

BACKGROUND ART

A work machine represented, for example, by a hydraulic excavator can perform complicated action efficiently by simultaneously driving a plurality of members that configure the work implement such as a boom and an arm.

In recent years, in order to ensure a high work efficiency in such a work machine as described above without depending upon the proficiency of the operator, a work supporting system has been proposed which decelerates, when its work implement comes near to a target plane, the work implement to prevent the work implement from contacting a surrounding obstacle.

For example, Patent Document 1 discloses a technology for area limiting control in which, after an operator sets an entry-prohibited area within a range within which the work implement can act before the work is started, the distance between the entry-prohibited area and the machine body is measured at the time of the work on the basis of sensor information, and then the work implement is decelerated and stopped such that the work implement does not enter the entry-prohibited area. Patent Document 1 further discloses a technology in which a claw tip position of the work implement is sensed and an entry-prohibited area plane for area limiting control is set.

PRIOR ART DOCUMENT

Patent Document

Patent Document 1: JP-H4-136324-A

SUMMARY OF THE INVENTION

Problem to be Solved by the Invention

Regarding the shape of the entry-prohibited area plane in a case where area limiting control is performed, for example, a shape is available in which a plane perpendicular to the crawler bottom plane is set as depicted in FIGS. 9, 19, and so forth of Patent Document 1, and thereby suppression of deviation in an extension direction of the work implement is performed.

Here, where a plane perpendicular to the crawler bottom plane is set as an entry-prohibited area plane, if the entry-prohibited area plane is set in the inside of a rear end radius circle of the upper swing structure, then while deviation suppression of the work implement can be implemented, there is the possibility that, when the upper swing structure performs a swing action, the rear end of the upper swing structure may enter the entry-prohibited area.

In order to set an entry-prohibited area plane at a position at which the rear end of the upper swing structure does not enter the entry-prohibited area, it is necessary for the operator to repeat trial and error, which is a burden on the operator.

It is an object of the present invention to provide a work machine that can reduce the burden on an operator when an entry-prohibited area plane for area limiting control is set.

Means for Solving the Problem

In order to attain the object described above, according to the present invention, there is provided a work machine comprising a lower track structure, an upper swing structure swingably mounted on an upper portion of the lower track structure, a work implement attached pivotally in an upward and downward direction at a front portion of the upper swing structure, and a controller that performs area limiting control such that the work implement does not enter an entry-prohibited area beyond an entry-prohibited area plane set in advance, wherein the work machine includes a setting operation device used for setting a target position of the entry-prohibited area plane, and the controller is configured to set the entry-prohibited area plane at the target position set by the setting operation device when a distance between the target position set by the setting operation device and a center of swing action of the upper swing structure is greater than a threshold value set based on a distance from the center of swing action of the upper swing structure to a rear end of the upper swing structure.

Advantage of the Invention

With the present invention, since the machine body side determines whether swing action is possible or not at the time of setting of the position of an entry-prohibited area plane, the burden on the operator at the time of position setting of the entry-prohibited area plane can be reduced.

MODES FOR CARRYING OUT THE INVENTION

In the following, embodiments of the present invention are described in detail with reference to the drawings.

First Embodiment

<Work Machine>

Figure 1:
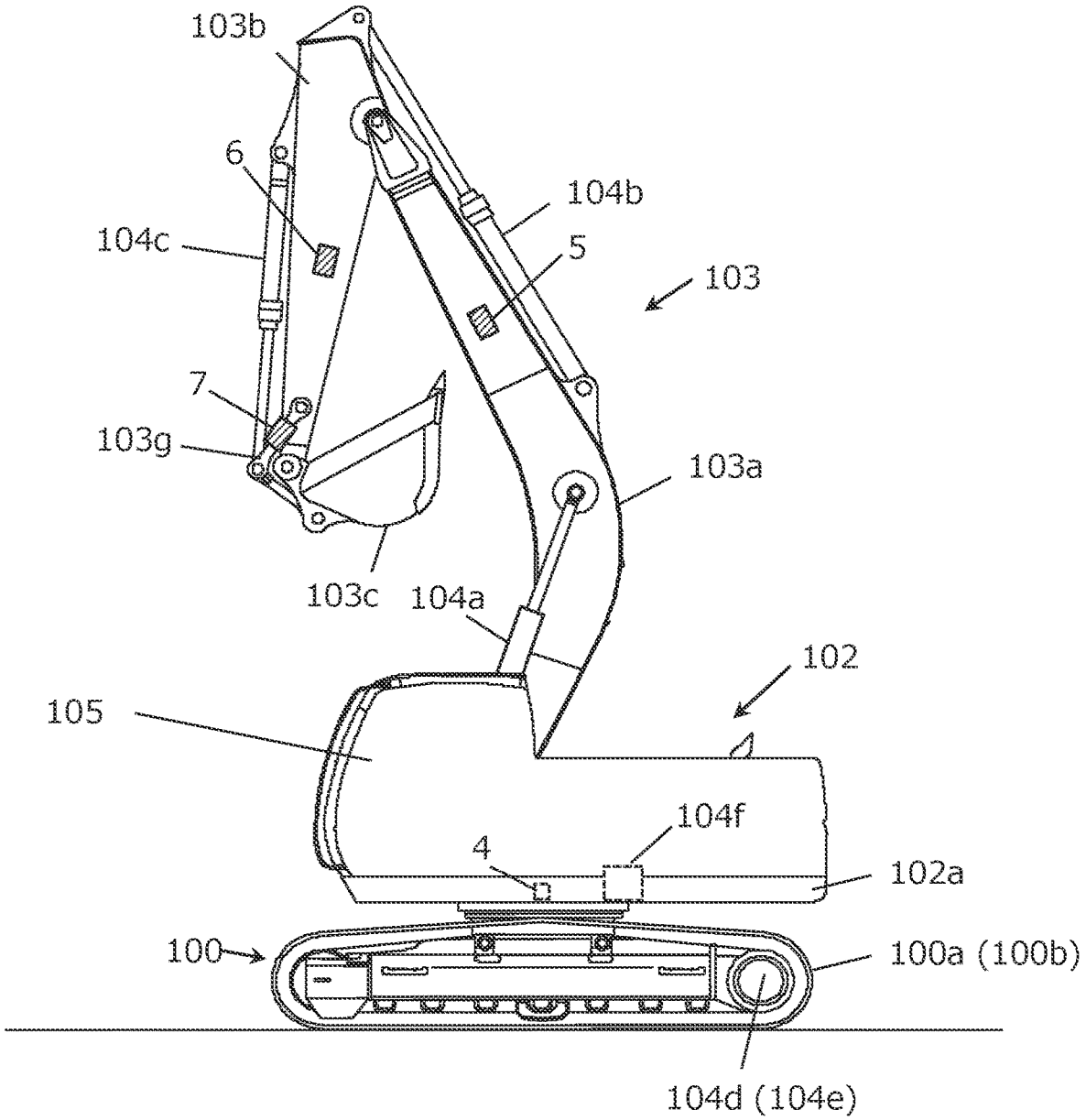
FIG. 1 is a view depicting a hydraulic excavator of the crawler type as an example of the work machine according to the present invention.

FIG. 1 is a view depicting a hydraulic excavator of the crawler type as an example of the work machine according to the present invention. It is to be noted that the present invention can be applied not only to a hydraulic excavator of the crawler type but also to work machines of the wheel type such as a hydraulic excavator and a hydraulic crane.

Referring to FIG. 1, the hydraulic excavator includes a lower track structure 100, an upper swing structure 102 swingably mounted on an upper portion of the lower track structure 100, and a work implement 103 attached pivotally in an upward and downward direction at a front portion of the upper swing structure 102 and configured from a boom 103*a*, an arm 103*b*, and a bucket 103*c* (a plurality of front members) coupled pivotally in the upward and downward direction to each other.

The lower track structure 100 includes left and right crawlers 100*a* and 100*b*.

The boom 103*a*, arm 103*b*, and bucket 103*c* are driven by a boom cylinder 104*a*, an arm cylinder 104*b*, and a bucket cylinder 104*c*, respectively. The left and right crawlers 100*a* and 100*b* are driven by left and right travel motors 104*d* and 104*e*, respectively. The upper swing structure 102 is driven by a swing motor 104*f* installed on a swing frame 102*a*.

On the swing frame 102*a* of the upper swing structure 102, a center joint (not depicted) is provided which connects hydraulic hoses positioned on the upper swing structure 102 side and hydraulic hoses positioned on the lower track structure 100 side to each other such that those hydraulic hoses are not twisted by the swing action of the upper swing structure 102. Further, an angle sensor 24 that senses a swing angle of the upper swing structure 102 with respect to the lower track structure 100 is provided on the center joint.

Further, on the boom 103*a*, arm 103*b*, and bucket 103*c*, a boom IMU sensor 25, an arm IMU sensor 26, and a bucket IMU sensor 27 are provided, respectively, as a plurality of posture sensors that sense the posture of the work implement 103. The boom IMU sensor 25, arm IMU sensor 26, and bucket IMU sensor 27 individually sense the posture of the work implement 103 from changes in kinetic momentum of the sensor elements.

A cabin 105 that forms the operator cab is installed at a left side front portion of the upper swing structure 102.

<Inside of Cabin>

Figure 2:
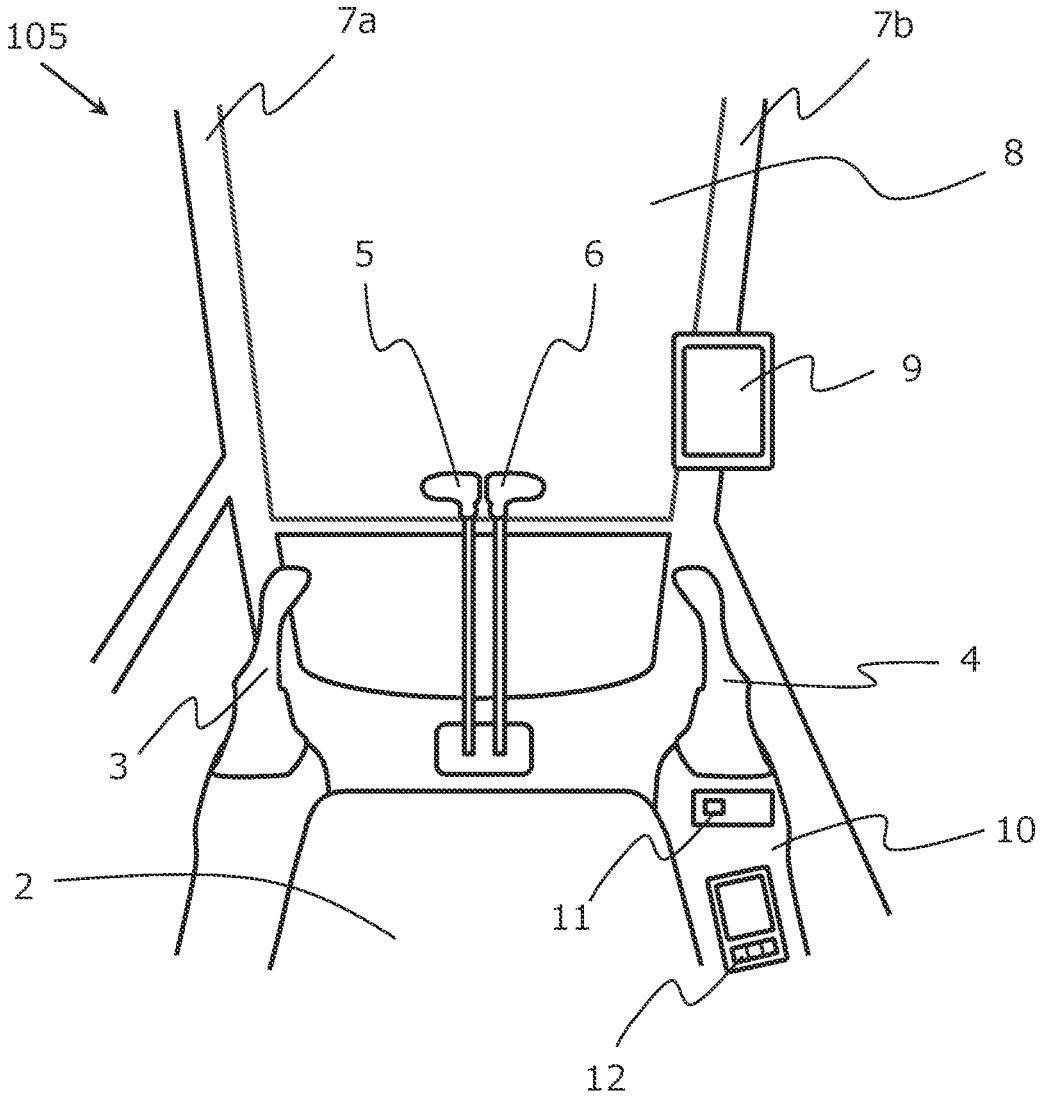
FIG. 2 is a view of the inside (operator cab) of the cabin of the hydraulic excavator according to the present invention as viewed from the operator seat side.

FIG. 2 is a view of the inside (operator cab) of the cabin 105 of the hydraulic excavator according to the present invention as viewed from the operator seat side.

Referring to FIG. 2, in the inside of the cabin 105, an operator seat 2 on which an operator is to sit, operation lever devices 3 and 4 that issue instructions of action of the upper swing structure 102 and the work implement 103 (boom 103*a*, arm 103*b*, and bucket 103*c*), and operation lever devices 5 and 6 that issue instructions of action of the lower track structure 100 (left and right crawlers 100*a* and 100*b*) are disposed.

The operation lever devices 3 and 4 are provided on the left and right in front of the operator seat 2, and the left side operation lever device 3 issues instructions of action of the arm 103*b* and the upper swing structure 102, and the right side operation lever device 4 issues instructions of action of the boom 103*a* and the bucket 103*c*.

The operation lever devices 5 and 6 are provided side by side at a middle portion of the floor on the front side of the operator seat 2, and the left side operation lever device 5 issues instructions of action of the left crawler 100*a*, and the right side operation lever device 6 issues instructions of action of the right crawler 100*b*.

Further, the cabin 105 has two pillars 7*a* and 7*b* that support the front side of the roof unit, and a windshield 8 is fitted between the two pillars 7*a* and 7*b*. Further, on the pillar 7*b* on the right side as viewed from the operator seat 2, a monitor 9 is installed which is used for setting of an entry-prohibited area plane, other vehicle body setting, and field-of-view assistance. Further, the monitor 9 has a function of displaying details of area limiting control (ON/OFF of area limiting control, position and validity/invalidity of an entry-prohibited area plane, and validity/invalidity of deceleration control).

Furthermore, on the rear side of the operation lever device 4 on the right side of the operator seat 2, and particularly, on the right side of the operator seated on the operator seat 2, a console box 10 is provided. A console switch 11 and a monitor operation device 12 are provided as a setting operation device used for setting of a target position of the entry-prohibited area plane for the area limiting control are provided on the console box 10.

<Hydraulic System>

Figure 3:
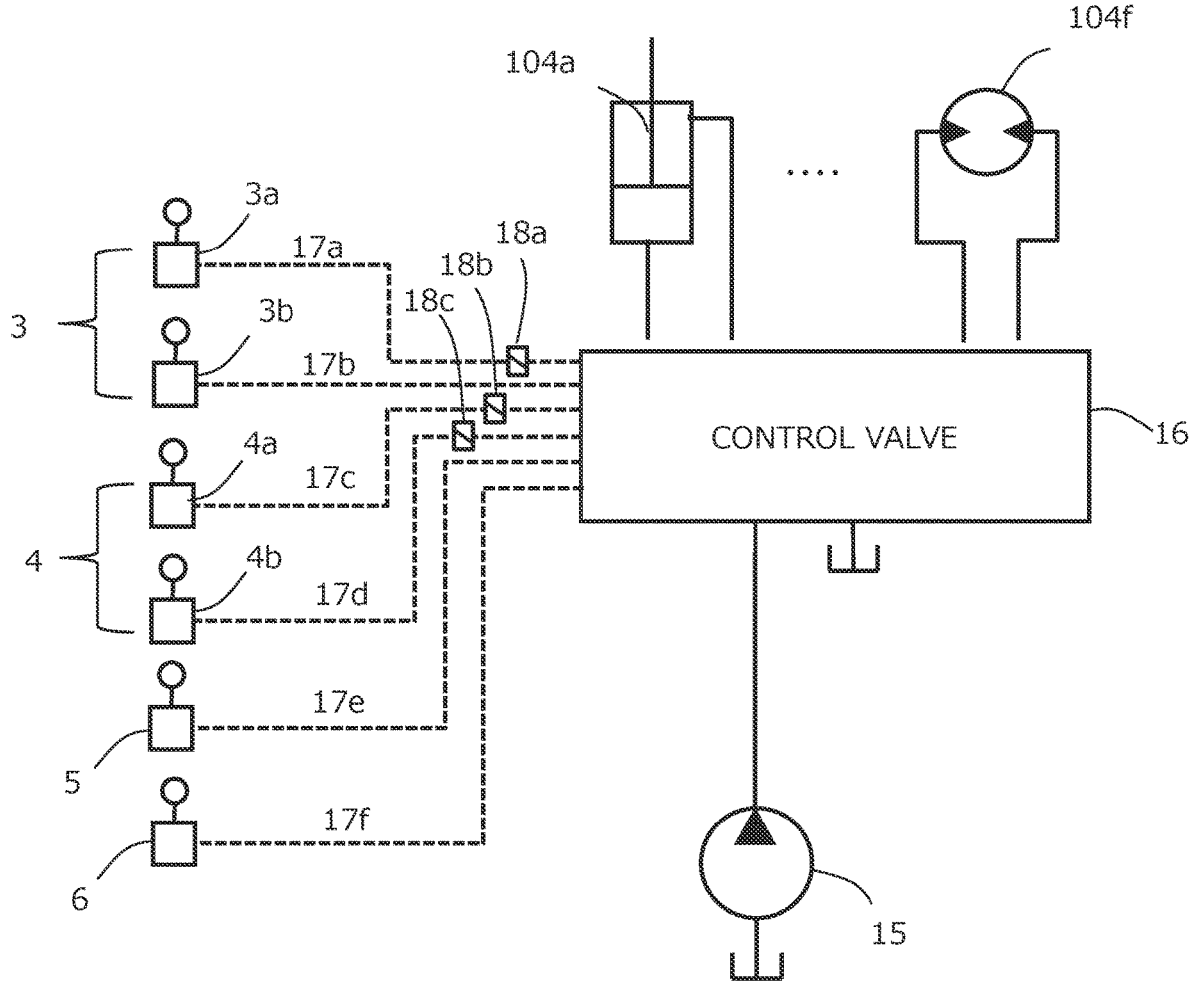
FIG. 3 is a diagram depicting a hydraulic system for driving the work implement (boom, arm, and bucket), lower track structure (left and right crawlers), and upper swing structure.

FIG. 3 is a diagram depicting a hydraulic system for driving the work implement 103 (boom 103*a*, arm 103*b*, and bucket 103*c*), lower track structure 100 (left and right crawlers 100*a* and 100*b*), and upper swing structure 102.

Referring to FIG. 3, the hydraulic system includes a hydraulic pump 15, a plurality of actuators (boom cylinder 104*a*, arm cylinder 104*b*, bucket cylinder 104*c*, left and right travel motors 104*d* and 104*e*, and swing motor 104*f*) driven by hydraulic fluid delivered from the hydraulic pump 15, a control valve 16 that includes a plurality of spool valves that control the flow rate and the flowing direction of hydraulic fluid to be supplied from the hydraulic pump 15 to the plurality of actuators, and the above-described operation lever devices 3, 4, 5, and 6 that generate an operation pilot pressure for switching the plurality of spool valves of the control valve 16.

It is to be noted that, in FIG. 3, the operation lever device 3 is depicted separately as a portion 3*a* that issues instructions of action of the arm 103*b* and the upper swing structure 102 and a portion 3*b* that issues instructions of action of the upper swing structure 102, and the operation lever device 4 is depicted separately as a portion 4*a* that issues instructions of action of the boom 103*a* and a portion 4*b* that issues instructions of action of the bucket 103*c*. In the following description, each of the portions 3*a*, 3*b*, 4*a*, and 4*b* is referred to as an operation lever device.

The operation devices 3*a*, 3*b*, 4*a*, 4*b*, 5, and 6 are connected to the control valve 16 through pilot lines 17*a*, 17*b*, 17*c*, 17*d*, 17*e*, and 17*f*, respectively, such that an operation pilot pressure generated by them is introduced into the spool valves of the control valve 16 through the pilot lines 17*a*, 17*b*, 17*c*, 17*d*, 17*e*, and 17*f*, respectively. The spool valves of the control valve 16 are switched by the operation pilot pressure and control the flow rate and the flowing direction of hydraulic fluid to be supplied from the hydraulic pump 15 to the plurality of actuators.

In the pilot lines 17*a*, 17*c*, and 17*d* of the operation lever devices 3*a*, 4*a*, and 4*b*, pressure reducing valves 18*a*, 18*b*, and 18*c* are provided, respectively. When area limiting control is performed, the pressure reducing valves 18*a*, 18*b*, and 18*c* are rendered operative to reduce the operation pilot pressure to perform deceleration and stopping control of the work implement 103.

It is to be noted that, in order for the operation device devices 3*a*, 3*b*, 4*a*, 4*b*, 5, and 6 to individually generate two operation pilot pressures for instructions of action in opposite directions of the boom 103*a*, arm 103*b*, bucket 103*c*, upper swing structure 102, and left and right crawlers 100*a* and 100*b*, for each of the pilot lines 17*a*, 17*b*, 17*c*, 17*d*, 17*e*, and 17*f*, two pilot lines are provided for each one operation lever device. However, in FIG. 2, two pilot lines are indicated by one pilot line for simplified illustration. The pressure reducing valves 18*a*, 18*b*, and 18*c* are provided for each of the two pilot lines 17*a*, 17*b*, and 17*d*, respectively.

<Control System>

Figure 4:
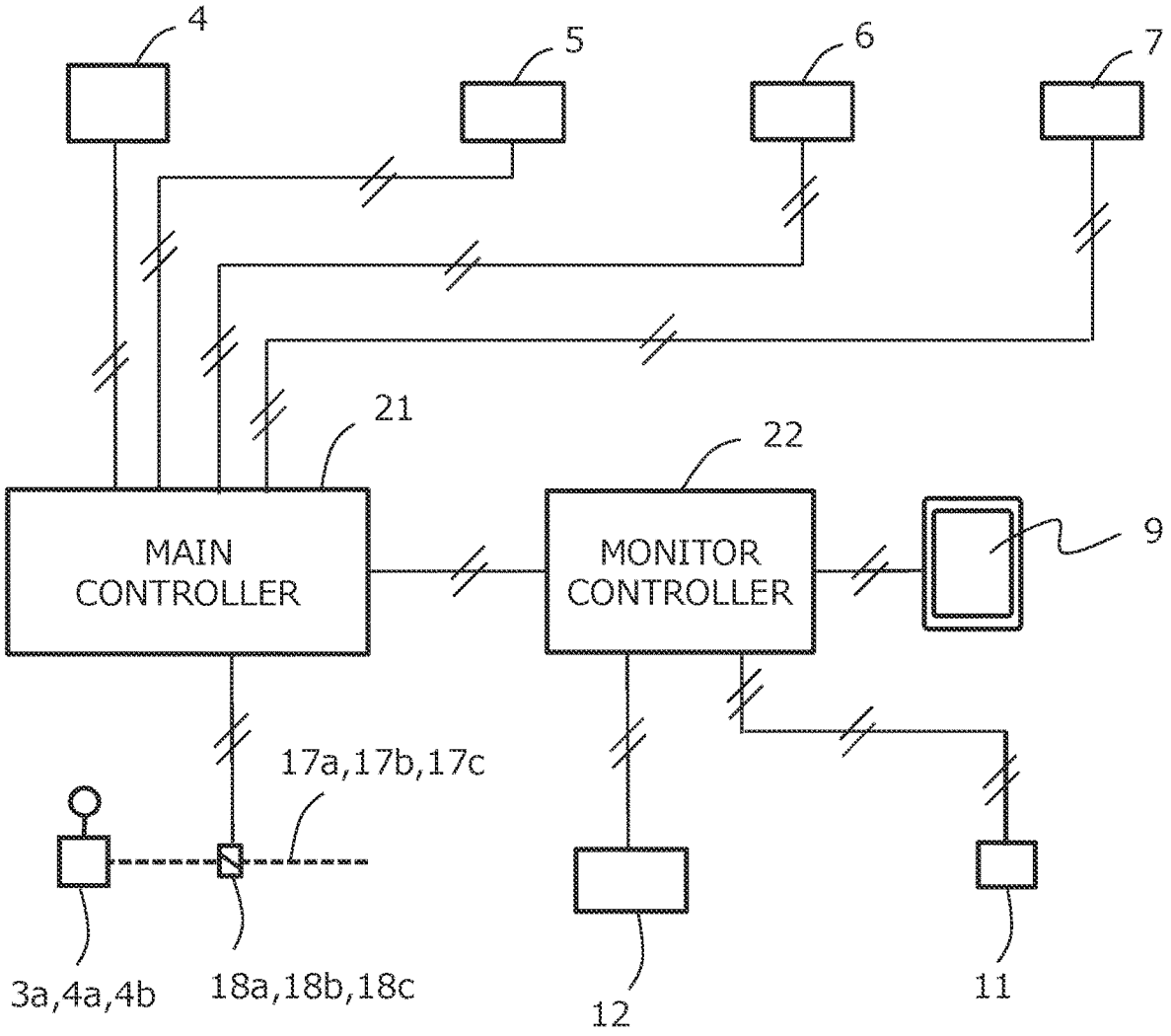
FIG. 4 is a diagram depicting a control system of a hydraulic excavator according to a first embodiment of the present invention.

FIG. 4 is a diagram depicting a control system of the hydraulic excavator according to the present embodiment.

Referring to FIG. 4, the control system includes the angle sensor 24, boom IMU sensor 25, arm IMU sensor 26, bucket IMU sensor 27, monitor 9, console switch 11 and monitor operation device 12, and pressure reducing valves 18*a*, 18*b* and 18*c* described above, and a main controller 21 that carries out area limiting control, setting of entry-prohibited area plane and other various functions, and a monitor controller 22 that carries out monitor control.

The main controller 21 is disposed, for example, at the rear side of the operator seat 2. The monitor controller 22 is disposed, for example, at the lower side of the console box 10.

In the main controller 21, an entry-prohibited area plane including a vertical plane is set in advance as hereinafter described, and the main controller 21 performs area limiting control such that the work implement 103 does not enter an entry-prohibited area beyond the entry-prohibited area plane set in advance.

Further, the main controller 21 is configured to set the entry-prohibited area plane at the target position when a distance between the target position set by the console switch 11 or the monitor operation device 12 (setting operation device) and a center of swing action of the upper swing structure 102 is greater than a threshold value set based on a distance from the center of swing action of the upper swing structure 102 to a rear end of the upper swing structure 102.[0038]

In the present invention, an entry-prohibited area plane including a vertical plane is targeted. The vertical plane signifies a plane perpendicular to the crawler bottom plane of the lower track structure 100 (bottom plane of the left and right crawlers 100*a* and 100*b*). The entry-prohibited area plane may include a plane other than a vertical plane, for example, an inclined plane or a curved plane if the plane includes a vertical plane.

In the following, a case is described in which the entry-prohibited area plane is a vertical plane. Where the entry-prohibited area plane includes a plane other than a vertical plane, it is sufficient if the following operation or processes by the main controller 21 are applied to the vertical plane portion of the entry-prohibited area plane.

The operator, when an entry-prohibited area plane is to be set, operates the monitor operation device 12 to turn an entry-prohibited area plane setting mode ON.

An ON signal of the entry-prohibited area plane setting mode is transmitted from the monitor controller 22 to the main controller 21, and the main controller 21 places the setting function of an entry-prohibited area plane into a standby state.

Further, the operator, when an entry-prohibited area plane is to be set, performs operation for issuing instruction of a target position of an entry-prohibited area plane. For the target position instruction method for an entry-prohibited area plane, a method by positioning of the work implement 103 and a method by numerical inputting with use of the monitor operation device 12 are available.

Figure 5A:
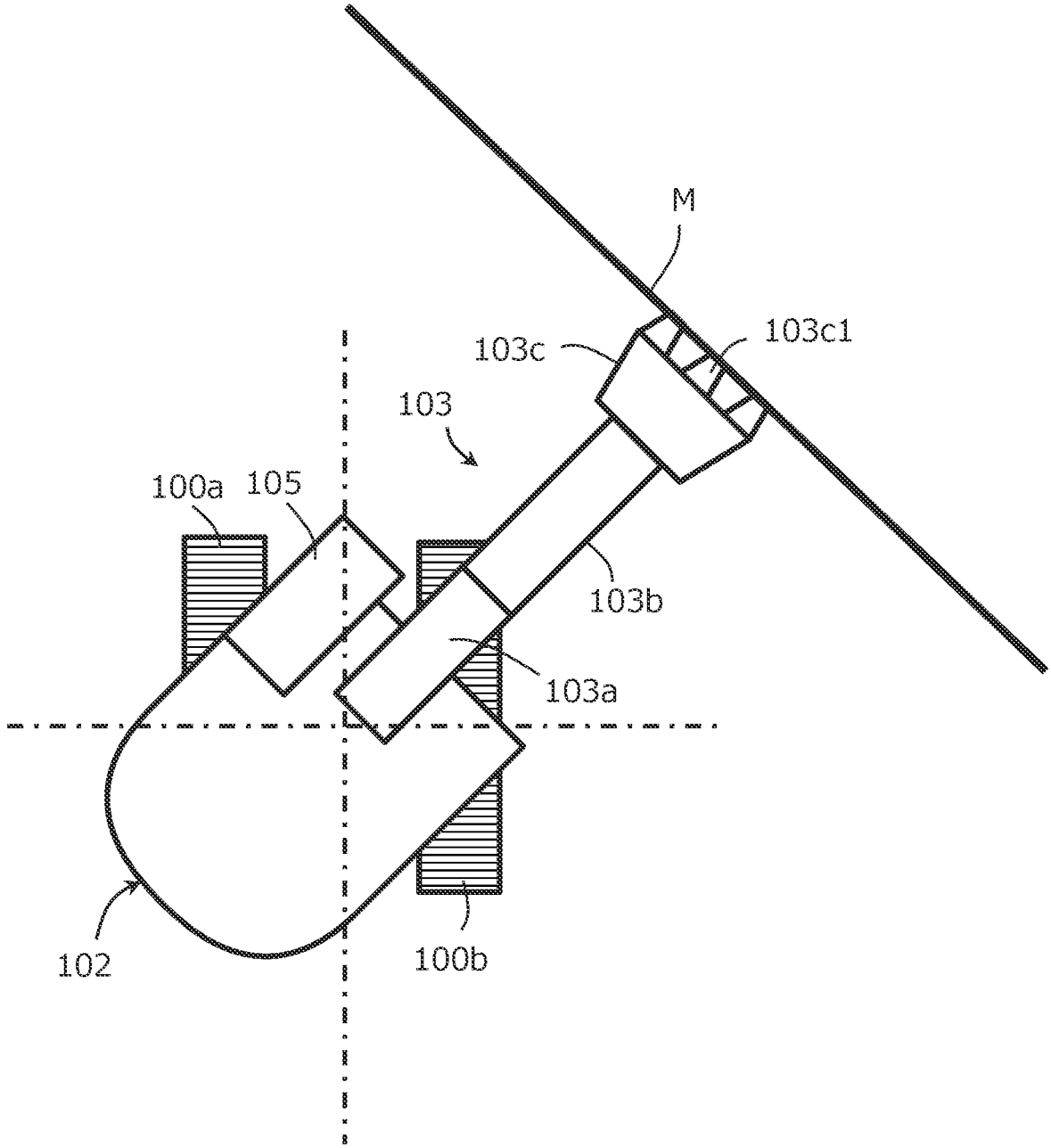
FIG. 5A is a diagrammatic view depicting a method by positioning of the work implement, as a target position instruction method for an entry-prohibited area plane.
Figure 5B:
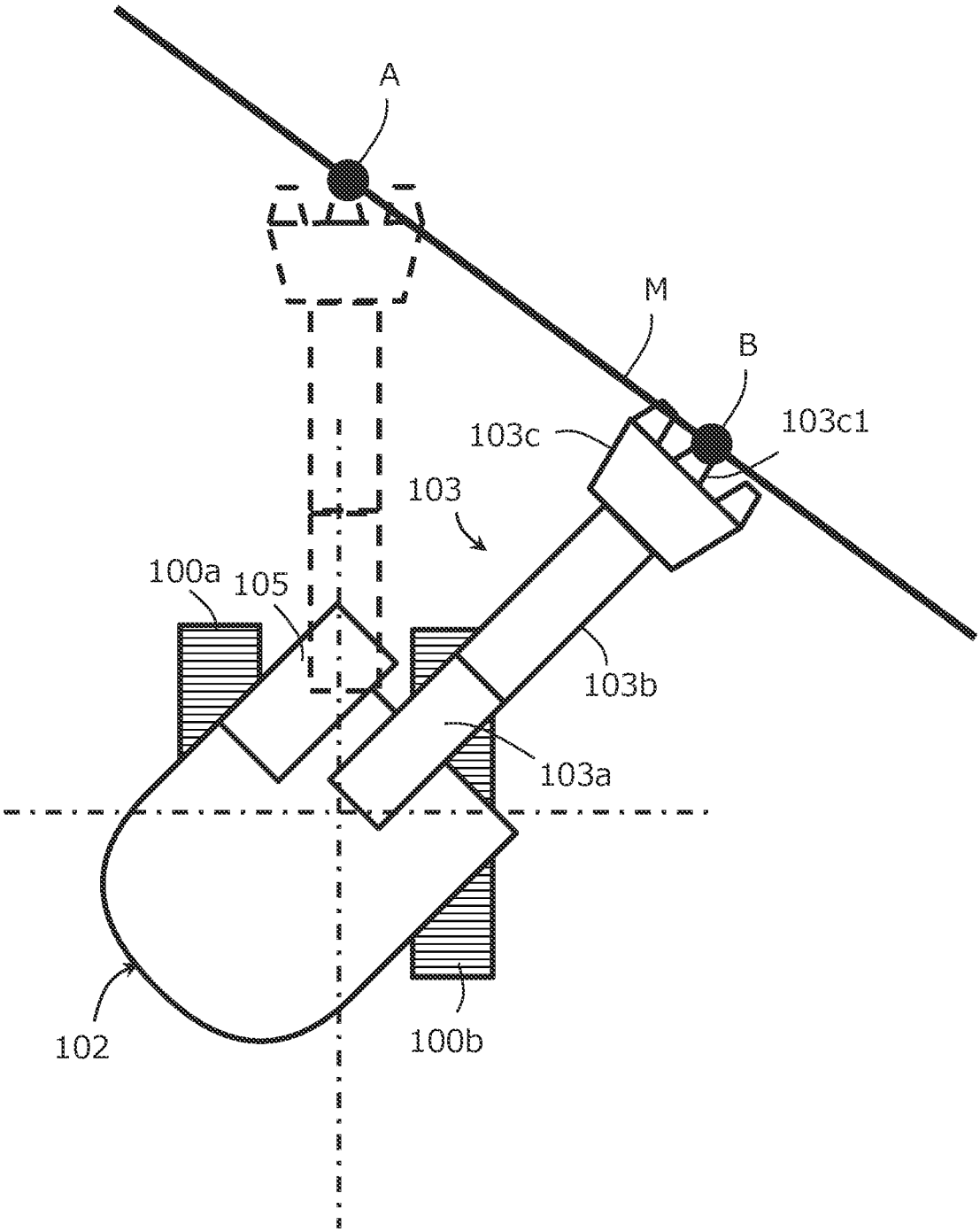
FIG. 5B is a diagrammatic view depicting another method by positioning of the work implement, as a target position instruction method for an entry-prohibited area plane.
Figure 5C:
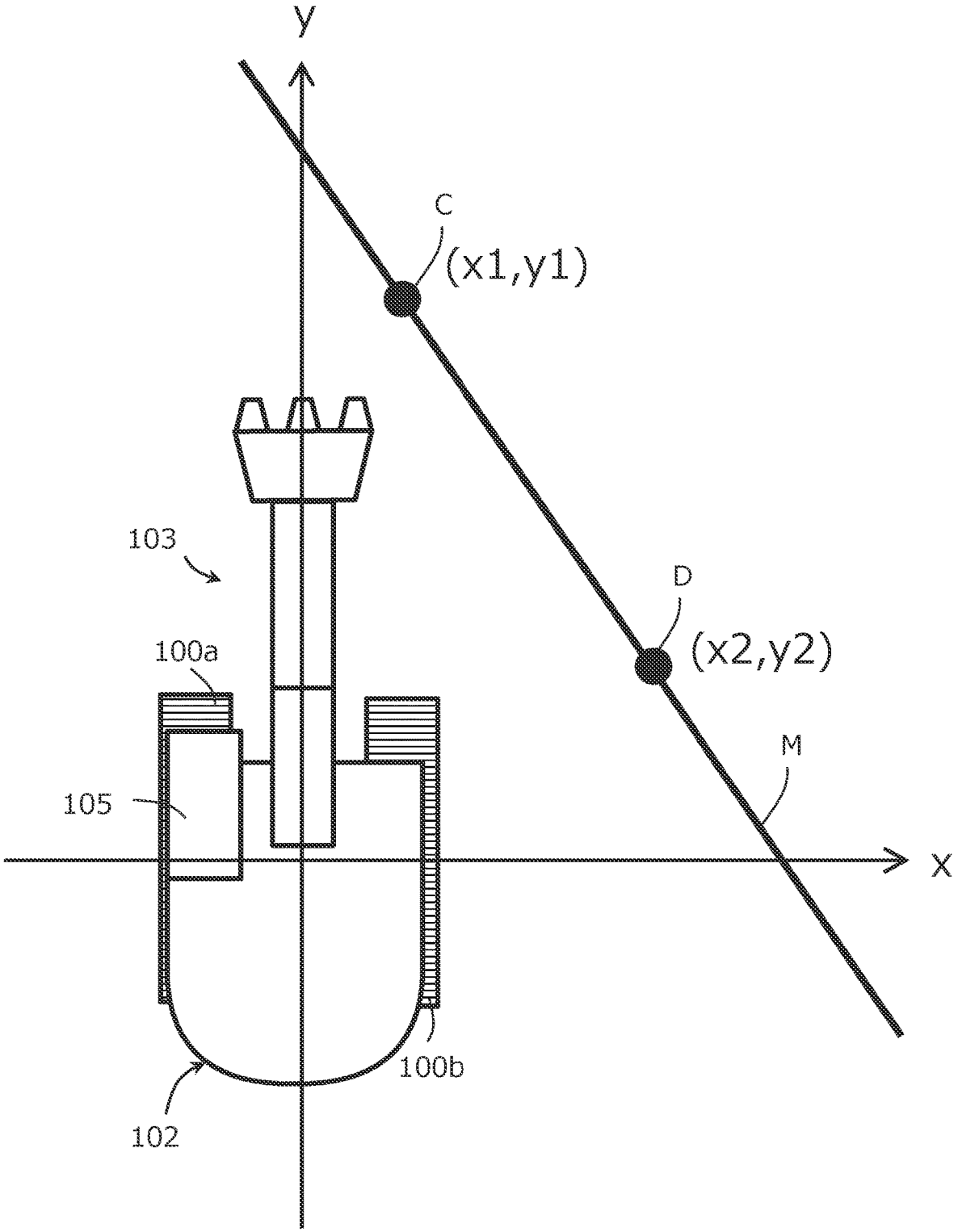
FIG. 5C is a diagrammatic view depicting a method by numerical inputting with use of a monitor operation device, as a target position instruction method for an entry-prohibited area plane.
Figure 5D:
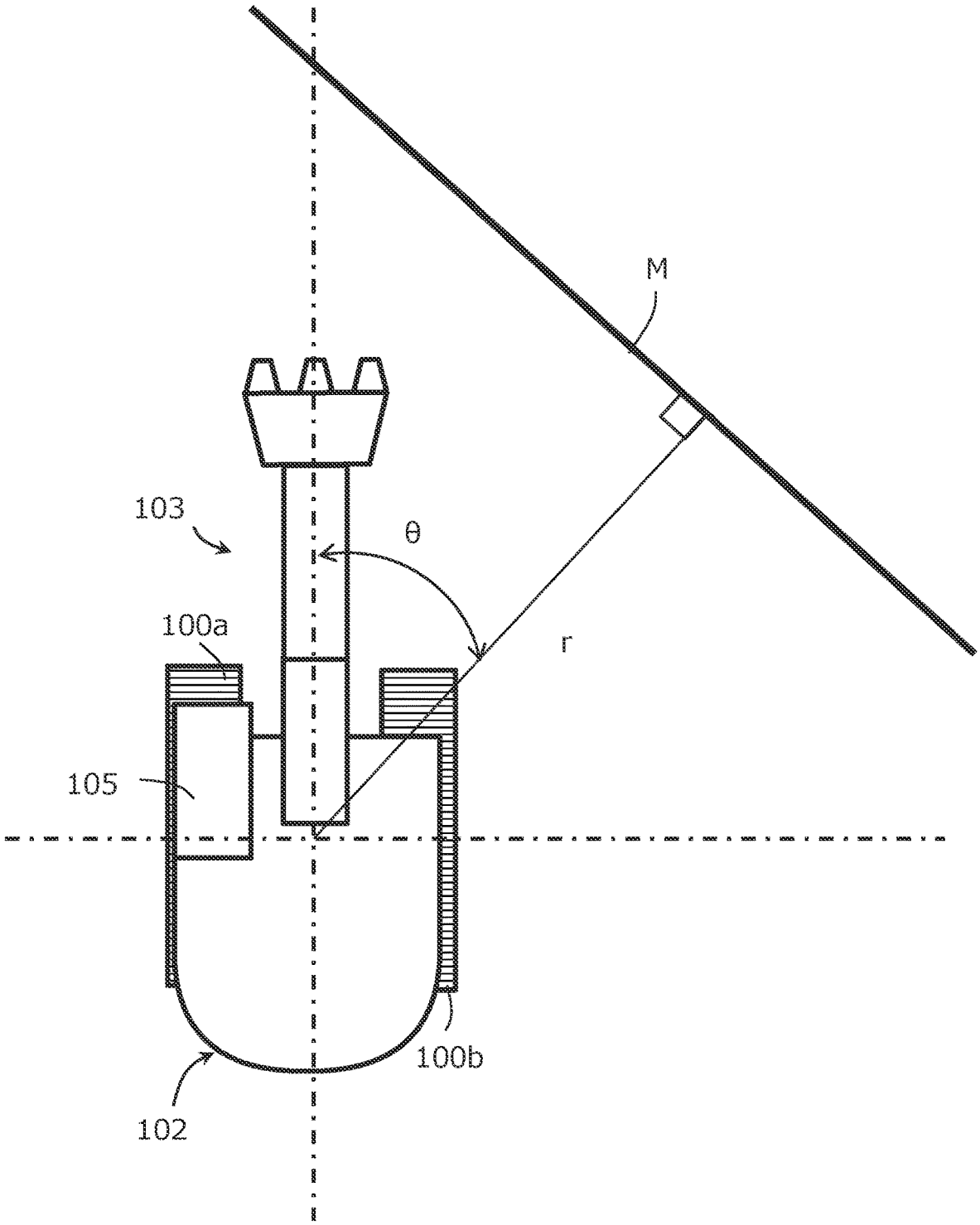
FIG. 5D is a diagrammatic view depicting another method by numerical inputting with use of a monitor operation device, as a target position instruction method for an entry-prohibited area plane.
Figure 5E:
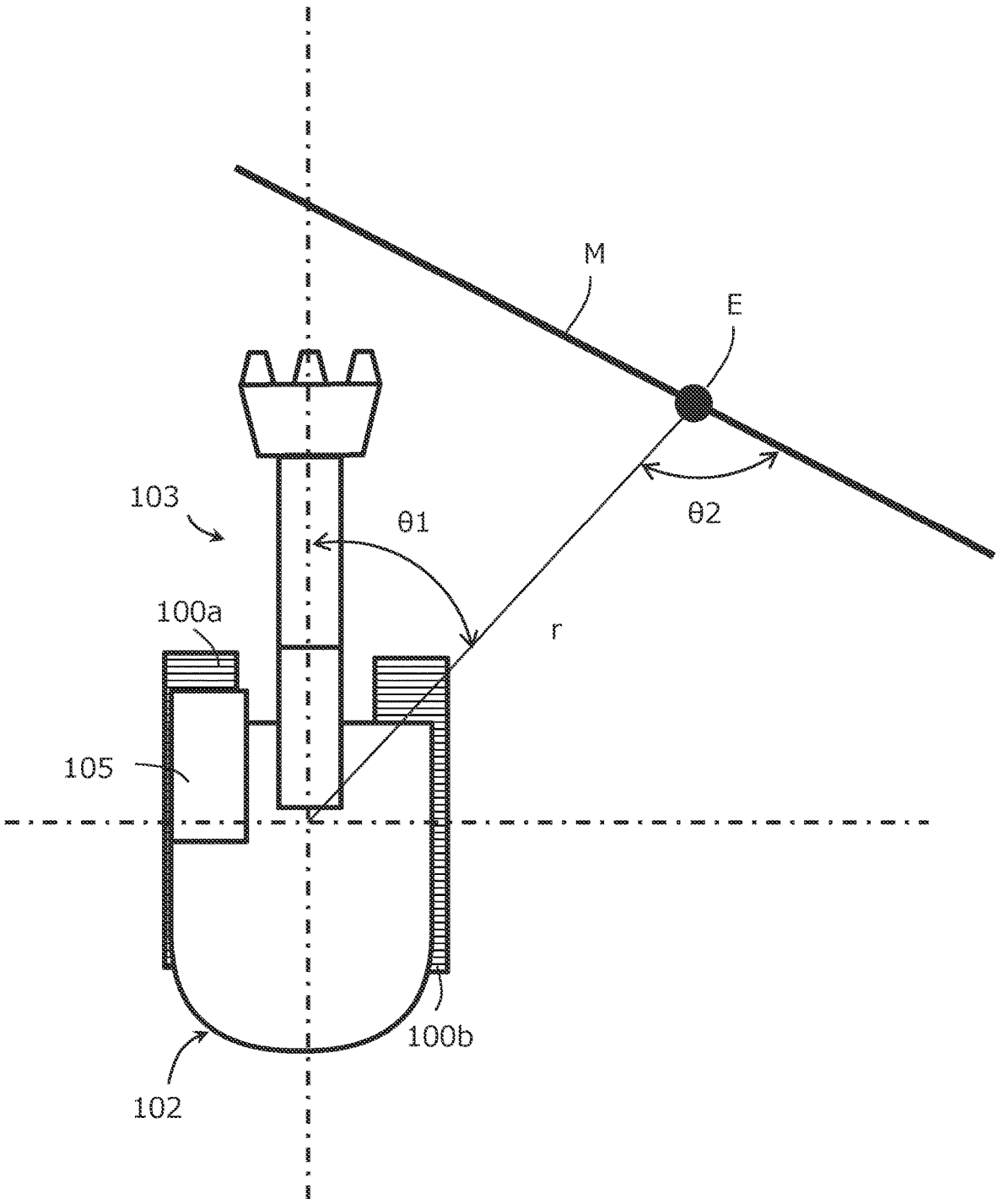
FIG. 5E is a diagrammatic view depicting a further method by numerical inputting with use of a monitor operation device, as a target position instruction method for an entry-prohibited area plane.

FIGS. 5A and 5B are diagrammatic views depicting the method by positioning of the work implement 103, and FIGS. 5C, 5D, and 5E are diagrammatic views depicting the method by numerical inputting with use of the monitor operation device 12.

It is necessary for the entry-prohibited area plane to be set at a position at which the rear end of the monitor operation device 12 does not enter the entry-prohibited area plane.

Further, in FIGS. 5A to 5E, the target position of the entry-prohibited area plane is indicated by a character M. In FIGS. 5A to 5E, the entry-prohibited area plane is viewed from a vertically upper direction, and the target position M is indicated by a horizontal cross section of the entry-prohibited area plane.

~FIG. 5A~

The operator performs operation to align all claw tips of a plurality of claws 103*c*1 formed at the distal end of the bucket 103*c* with the target position M of the entry-prohibited area plane by the operation lever devices 3*a*, 3*b*, 4*a*, and 4*b*, and depresses the console switch 11 when all claw tips of the plurality of claws 103*c*1 are aligned with to the target position M of the entry-prohibited area plane. When the console switch 11 is depressed, a switch signal is transmitted from the console switch 11 to the main controller 21 via the monitor controller 22. When the main controller 21 receives the signal from the console switch 11, the main controller 21 computes position information of a line segment that contacts with all claw tips of the plurality of claws 103*c*1 of the work implement 103 at that time on the basis of sensor signals from the angle sensor 24, boom IMU sensor 25, arm IMU sensor 26, and bucket IMU sensor 27. Further, the main controller 21 computes information of the target position M of the entry-prohibited area plane (for example, r1 and θ hereinafter described) at that time from the position information of the line segment and stores the computed information as target position information of the entry-prohibited area plane.

~FIG. 5B~

In FIG. 5B, by operation of the operation lever devices 3*a*, 3*b*, 4*a* and 4*b*, the operator align a specific point of the distal end of the bucket 103*c* (for example, the claw tip of a middle one of the plurality of claws 103*c*1) with each of two points A and B on the target position M of the entry-prohibited area plane and depresses the console switch 11 at each of the positions of the two points A and B. At this time, a switch signal is transmitted from the console switch 11 to the main controller 21 via the monitor controller 22. When the main controller 21 receives the signal from the console switch 11, the main controller 21 computes position information of the two points A and B at that time on the basis of sensor signals from the angle sensor 24, boom IMU sensor 25, arm IMU sensor 26, and bucket IMU sensor 27. Further, the main controller 21 computes information of the target position M of the entry-prohibited area plane (for example, r1 and θ hereinafter described) at that time from the position information of the two points A and B. Then, the main controller 21 stores the computed information as target position information of the entry-prohibited area plane.

~FIG. 5C~

Using the monitor operation device 12, as depicted in FIG. 5C, the operator displays, on the screen of the monitor 9, a top plan view of the hydraulic excavator and an orthogonal coordinate system defined by the origin given by the center of swing action of the upper swing structure 102, the x axis given by a straight line extending in the machine body leftward and rightward direction, and the y axis given by a straight line extending in the machine body forward and rearward direction (orthogonal to the x axis). Then, using the monitor operation device 12, the operator instructs two points C and D on the target position M of the entry-prohibited area plane on the screen of the monitor 9. The instruction of the two points C and D is performed by numerically inputting coordinate values (x1, y1) and (x2, y2) of the two points C and D. The coordinate values (x1, y1) and (x2, y2) of the two points C and D are distance information in the x-axis direction and the y-axis direction of the orthogonal coordinate system. The inputted distance information of the coordinate values (x1, y1) and (x2, y2) is transmitted to the main controller 21 via the monitor controller 22, and the main controller 21 receives the distance information of the coordinate values as information of the target position M of the entry-prohibited area plane.

~FIG. 5D~

In FIG. 5D, using the monitor operation device 12, the operator displays a polar coordinate system in place of the orthogonal coordinate system on the screen of the monitor 9. Then, using the monitor operation device 12, the operator instructs a radius vector r of the target position M of the entry-prohibited area plane from the center of swing action (origin) and a deflection angle θ on the screen of the monitor 9. Also this instruction is performed by numerically inputting the radius vector r and the deflection angle θ. The distance from the center of swing action to the entry-prohibited area plane coincides with the radius vector r, and the position of the entry-prohibited area plane rotates according to the deflection angle θ. The radius vector r and the deflection angle θ inputted by the monitor operation device 12 are transmitted to the main controller 21 via the monitor controller 22. The main controller 21 receives the radius vector r and the deflection angle θ as information of the target position M of the entry-prohibited area plane.

~FIG. 5E~

Using the monitor operation device 12, the operator displays a polar coordinate system on the screen of the monitor 9 similarly to the case of FIG. 5D and inputs a radius vector r and a deflection angle θ1 to instruct one point E on the target position M of the entry-prohibited area plane. Then, the operator inputs an angle θ2 of the target position M with respect to a line segment that passes the point E and the center of swing action to instruct the target position M of the entry-prohibited area plane on the screen of the monitor 9. The radius vector r, deflection angle θ1, and angle θ2 inputted by the monitor operation device 12 are transmitted to the main controller 21 via the monitor controller 22, and the main controller 21 receives the radius vector r, deflection angle θ, and angle θ2 as information of the target position M of the entry-prohibited area plane.

<Main Controller>

Now, details of a setting process of an entry-prohibited area plane performed by the main controller 21 is described with reference to FIGS. 6 and 7.

Figure 6:
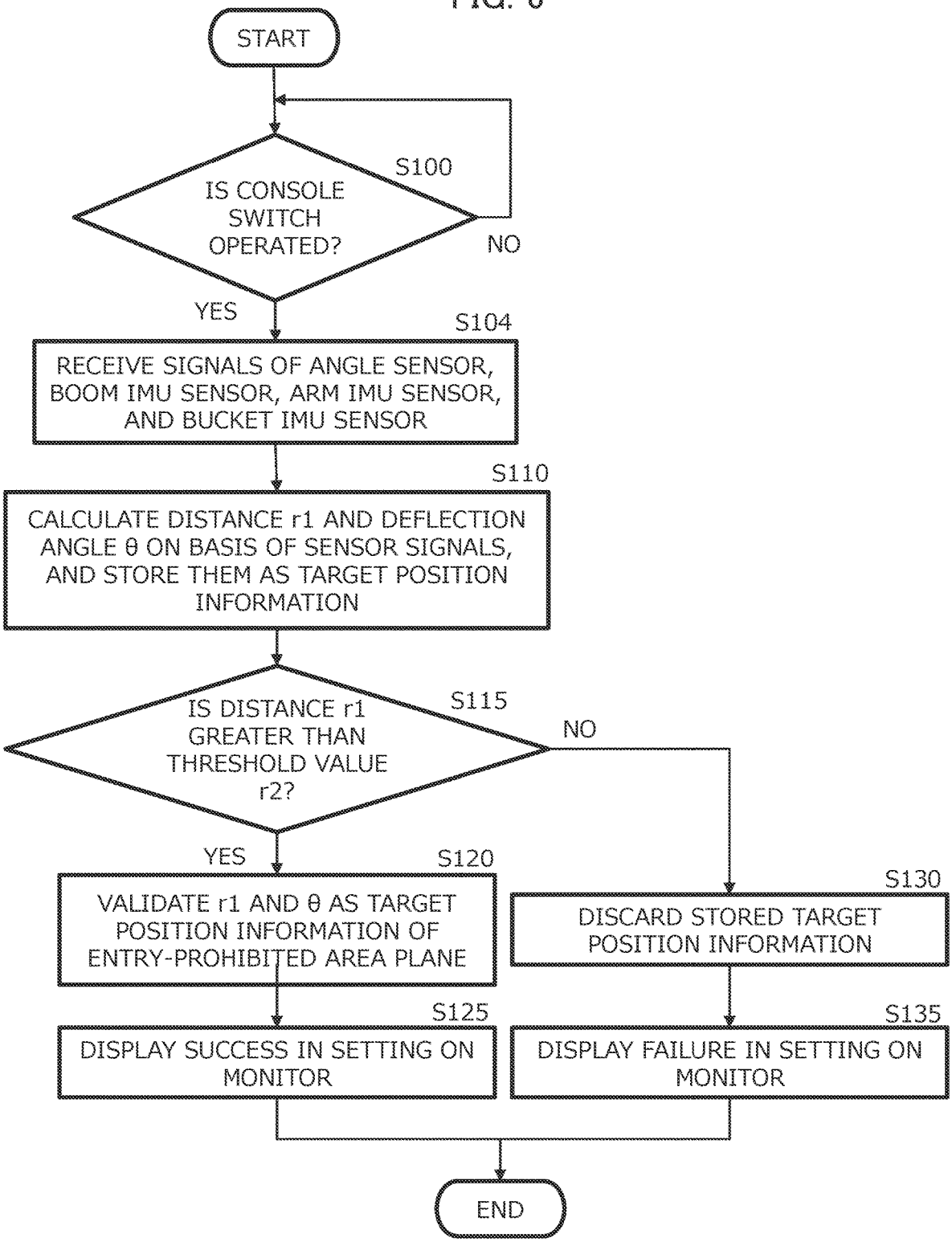
FIG. 6 is a flow chart depicting a processing procedure of setting of an entry-prohibited area plane by a main controller in the first embodiment of the present invention.

FIG. 6 is a flow chart depicting a processing procedure for setting of an entry-prohibited area plane by the main controller 21, and the processing procedure of this flow chart is executed repeatedly at every sampling time while the main controller 21 is operating. FIG. 7 is a diagrammatic view depicting a positional relation between an entry-prohibited area plane set by the main controller 21 and the hydraulic excavator.

Further, the processing procedure of FIG. 6 uses, as the target position instruction method for an entry-prohibited area plane, a method based on positioning of the work implement 103 depicted in FIG. 5A or 5B.

Referring to FIG. 6, the main controller 21 repeatedly decides first whether or not the console switch 11 is operated (step S100). In the meantime, the operator is performing operation to align all claw tips of the plurality of claws 103*c*1 of the bucket 103*c* with the target position M of the entry-prohibited area plane, and when all claw tips of the plurality of claws 103*c*1 of the bucket 103*c* are aligned with the target position M of the entry-prohibited area plane, the operator depresses the console switch 11. A signal of the console switch 11 is transmitted to the main controller 21 via the monitor controller 22. When the main controller 21 receives the signal from the console switch 11, the main controller 21 decides in step S100 that the console switch 11 is operated and receives signals of the angle sensor 24, boom IMU sensor 25, arm IMU sensor 26, and bucket IMU sensor 27 at that time (step S105).

Then, the main controller 21 computes position information of a line segment that is tangent to all claw tips of the plurality of claws 103*c*1 of the bucket 103*c* on the basis of the received sensor signals. Further, the main controller 21 computes, from the position information of the line segment, a distance r1 between the target position M of the entry-prohibited area plane and the center O of swing action of the upper swing structure 102 and a deflection angle θ, and stores them as target position information of the entry-prohibited area plane (step S110).

Figure 7:
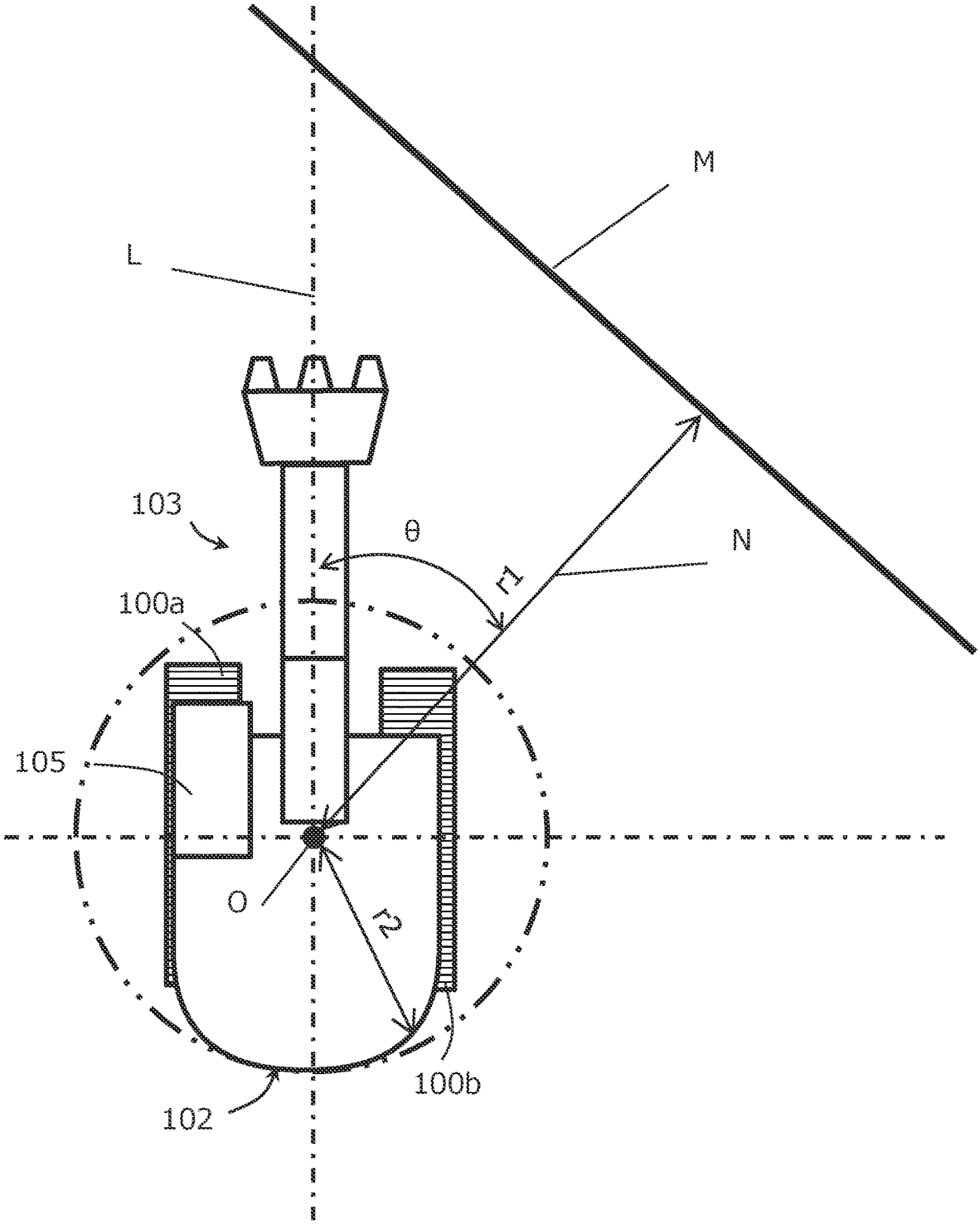
FIG. 7 is a diagrammatic view depicting a positional relation between an entry-prohibited area plane and the hydraulic excavator set by the main controller in the first embodiment.

Here, the distance r1 between the target position M of the entry-prohibited area plane and the center O of swing action of the upper swing structure 102 is a length of a perpendicular N to the target position M, which passes the center O of swing action of the upper swing structure 102, as depicted in FIG. 7, and this length is the shortest distance between the target position M and the center O of swing action. The deflection angle θ is an angle of the perpendicular N to the central axis L in the longitudinal direction of the work implement 103.

Then, the main controller 21 decides whether or not the distance r1 is greater than a threshold value set based on the distance r2 from the center O of swing action of the upper swing structure 102 to the rear end of the upper swing structure 102 (step S115). In the present embodiment, the threshold value is set to a value equal to the distance r2 from the center O of swing action of the upper swing structure 102 to the rear end of the upper swing structure 102. Namely, the threshold value is equal to r2.

The main controller 21 is configured to validate the distance r1 and the deflection angle θ as target position information of the entry-prohibited area plane when the distance r1 is greater than the threshold value r2, and sets the entry-prohibited area plane at the target position M (step S120) and controls the monitor 9 to display that setting of an entry-prohibited area plane results in success (step S125).

On the other hand, the main controller 21 erases and discards the stored target position information (distance r1 and deflection angle θ) (step S130) when the distance r1 is equal to or smaller than the threshold value r2, and controls the monitor 9 to display that setting of an entry-prohibited area plane results in failure (step S135).

<Advantage>

In the present embodiment configured in this manner, only an entry-prohibited area plane into which the rear end of the upper swing structure 102 does not enter is selected and set automatically. Then, where an entry-prohibited area plane is set, the monitor 9 in the cabin 105 displays that setting of an entry-prohibited area plane results in success, but where an entry-prohibited area plane is not set, the monitor 9 displays that setting of an entry-prohibited area plane results in failure. Therefore, the operator can precisely grasp a result of setting of an entry-prohibited area plane, and the burden on the operator can be reduced when an entry-prohibited area plane for area limiting control is set.

It is to be noted that, although, in the present embodiment, a value equal to the distance r2 from the center O of swing action of the upper swing structure 102 to the rear end of the upper swing structure 102 is set as the threshold value for use for decision of the distance r1, a value that is obtained by adding a predetermined distance to the distance r2 and therefore is greater than the distance r2 may be set as the threshold value.

Depending upon the situation of the work site, some other worker may engage in some work near an entry-prohibited area plane in an entry-prohibited area. In such a case, if the threshold value to be used for decision of the distance r1 is set to a value greater than the swing structure rear end radius r2, then even if the worker enters the work area of the hydraulic excavator beyond the entry-prohibited area plane from within the entry-prohibited area, the distance between the rear end of the upper swing structure 102 and the worker can be secured.

<Second Embodiment>

A second embodiment of the present invention is described with reference to FIGS. 8 and 9.

Figure 8:
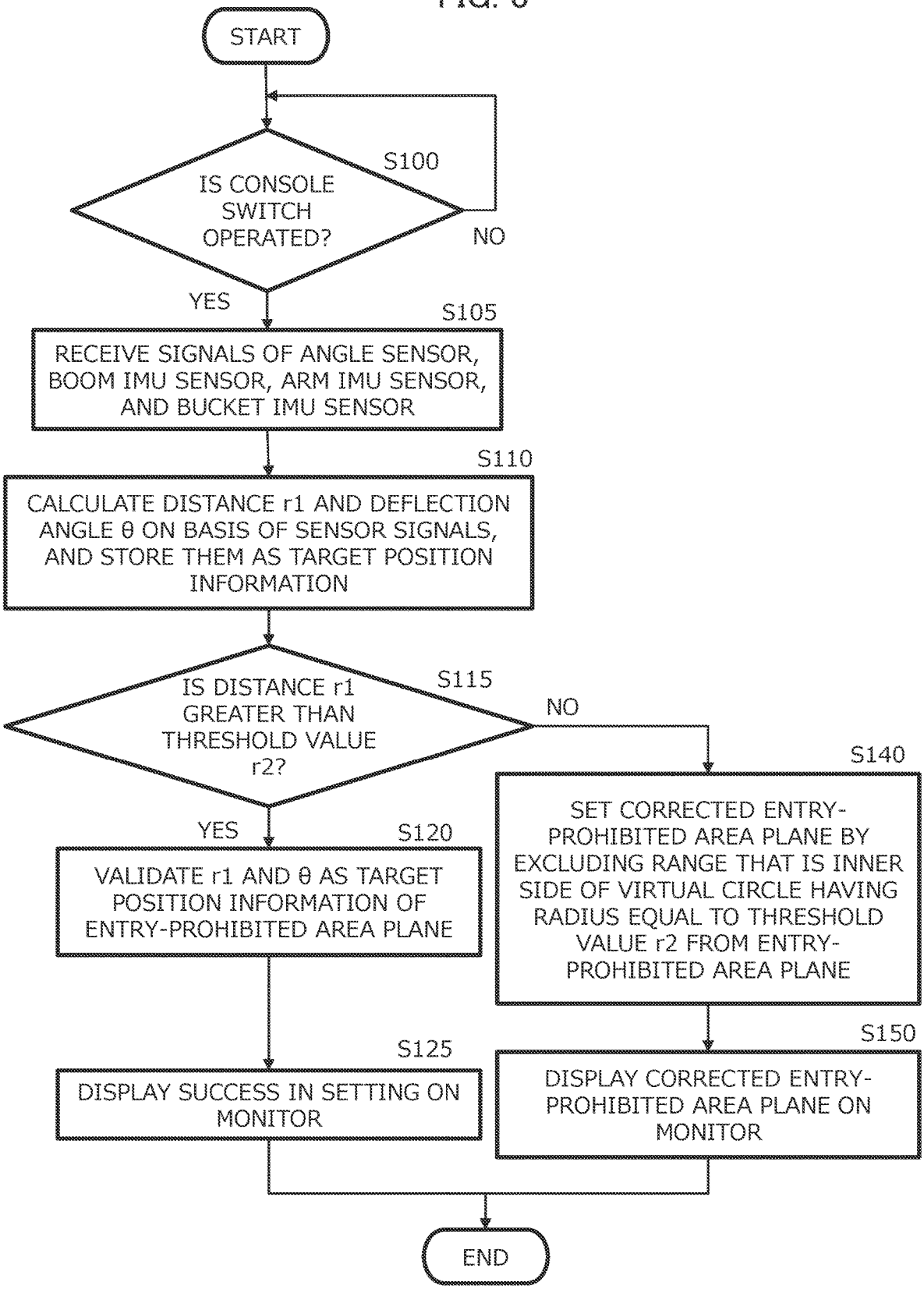
FIG. 8 is a flow chart depicting a processing procedure for setting of an entry-prohibited area plane by a main controller in a second embodiment of the present invention.
Figure 9:
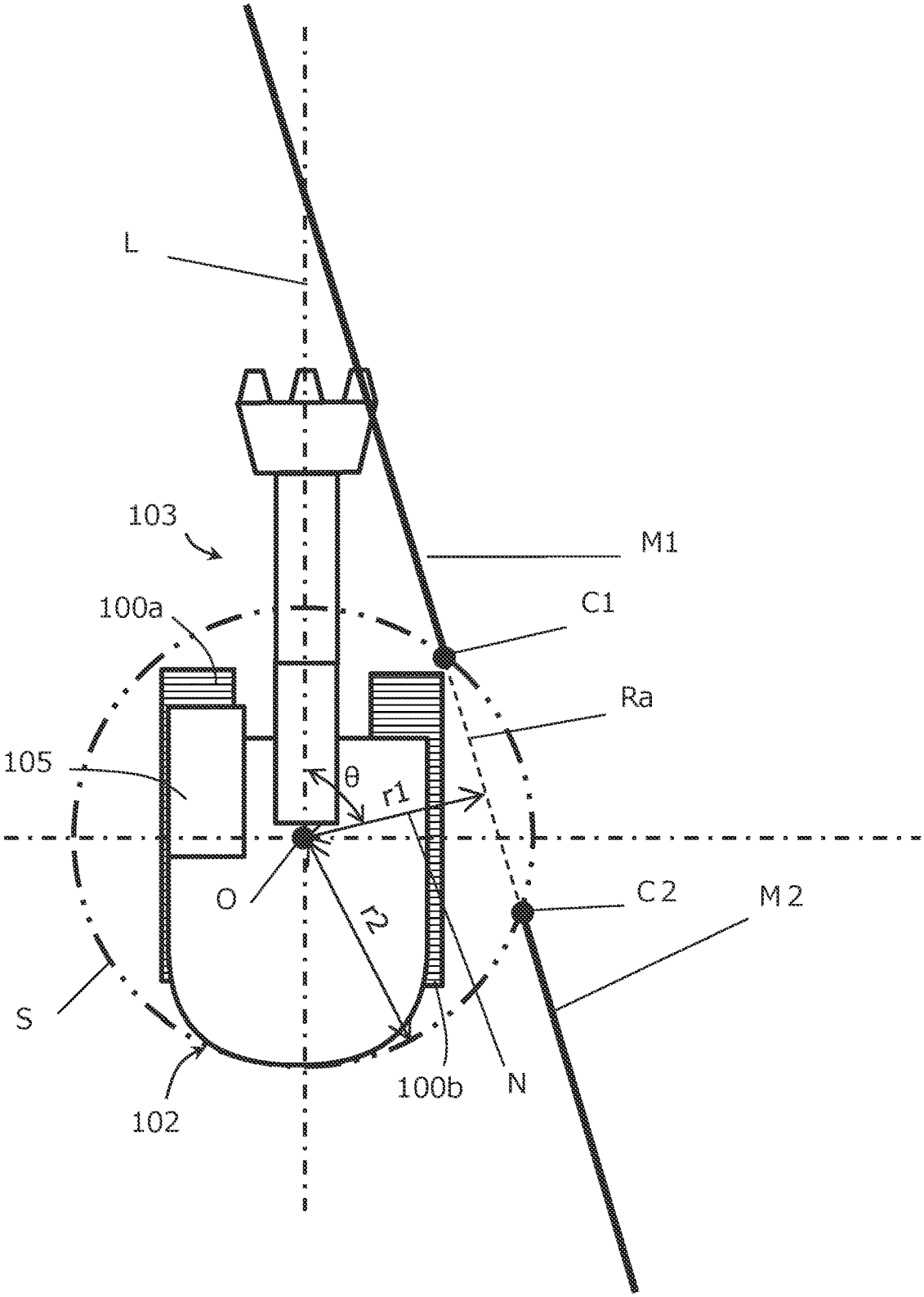
FIG. 9 is a diagrammatic view depicting a positional relation between an entry-prohibited area plane and the hydraulic excavator set by the main controller in the second embodiment of the present invention.

FIG. 8 is a flow chart depicting a processing procedure for setting of an entry-prohibited area plane by the main controller 21 according to the present embodiment. FIG. 9 is a diagrammatic view depicting a positional relation between an entry-prohibited area plane set by the main controller 21 and the hydraulic excavator.

Referring to FIG. 8, the processing procedure in steps S100 to S125 of the present embodiment is same as the processing procedure of the flow chart depicted in FIG. 6 according to the first embodiment. In the present embodiment, the processing procedure after step S125 is different from the processing procedure in steps S130 and S135 depicted in FIG. 6 in the first embodiment.

In particular, in the present embodiment, the main controller 21 is configured to set a corrected entry-prohibited area plane as the entry-prohibited area plane when, in step S115, the distance r1 between the target position M of the entry-prohibited area plane set by the console switch 11 (setting operation device) and the center O of swing action of the upper swing structure 102 is equal to or smaller than the threshold value r2 (step S140). The corrected entry-prohibited area plane is an area plane determined by excluding a range inside the virtual circle S having a radius equal to the threshold value r2 from the entry-prohibited area plane when the entry-prohibited area plane is set at the target position M.

More particularly, in step S140, the main controller 21 computes positions of two intersection points C1 and C2 between the virtual circle S having a radius equal to the threshold value r2 in the entry-prohibited area plane and the entry-prohibited area plane when the entry-prohibited area plane is set at the target position M, excludes target position information of an inner side range (range that is the inner side of the virtual circle S having a radius equal to the threshold value r2) Ra positioned between the intersection points C1 and C2 from the target position information of the entry-prohibited area plane to set target positions M1 and M2, and sets a corrected entry-prohibited area plane at the target positions M1 and M2.

Then, the main controller 21 controls the monitor 9 to display the target positions M1 and M2 as the corrected entry-prohibited area plane (step S150).

In the present embodiment configured in this manner, when the decision in step S115 is in the positive, processes similar to those in the first embodiment are performed, and therefore, advantages similar to those of the first embodiment are obtained.

Further, when the operator sets an entry-prohibited area plane to perform a work, there is a case in which the operator grasps the situation around the machine body sufficiently and even if a rear portion of the upper swing structure 102 only a little enters the entry-prohibited area plane, it can be decided that a swing action is permissible. In such a case where the entry-prohibited area plane is used for prevention of excessive excavation or the like, the swing action is permissible.

In such a case as described above, according to the present embodiment, as an entry-prohibited area plane, the corrected entry-prohibited area plane obtained by excluding the range Ra inside the virtual circle S having a radius equal to the threshold value r2 is set, and this corrected entry-prohibited area plane is displayed on the monitor 9 to give the operator an opportunity to decide whether or not the set entry-prohibited area plane is to be adopted, and when the operator decides that the entry-prohibited area plane can be adopted, it is possible for the operator to set the entry-prohibited area plane and perform the work. This eliminates the necessity for a work for setting an entry-prohibited area plane again, and an advantage that the convenience in setting of an entry-prohibited area plane is improved is obtained.

<Third Embodiment>

A third embodiment of the present invention is described with reference to FIGS. 10 and 11.

Figure 10:
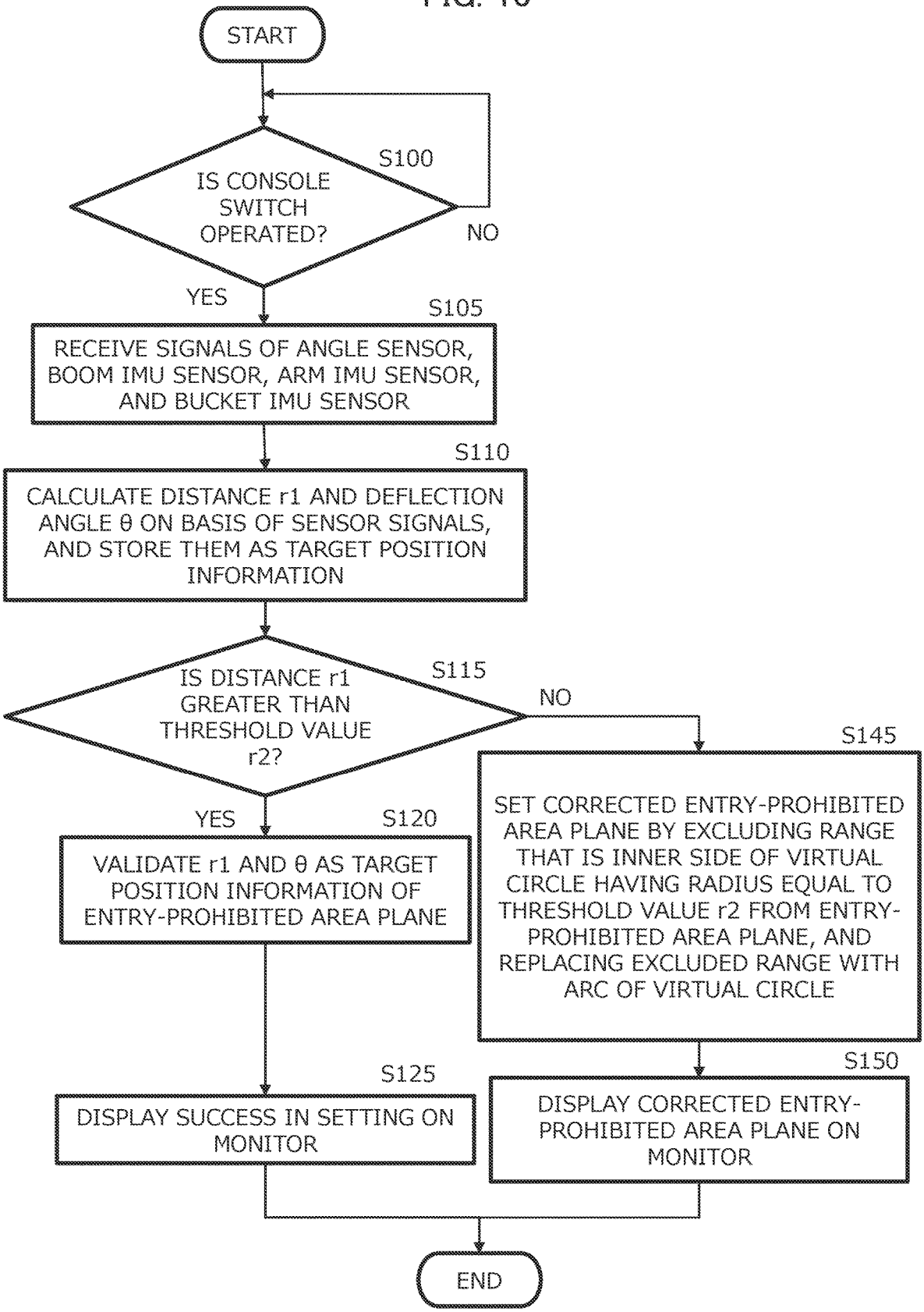
FIG. 10 is a flow chart depicting a processing procedure for setting of an entry-prohibited area plane by a main controller in a third embodiment of the present invention.
Figure 11:
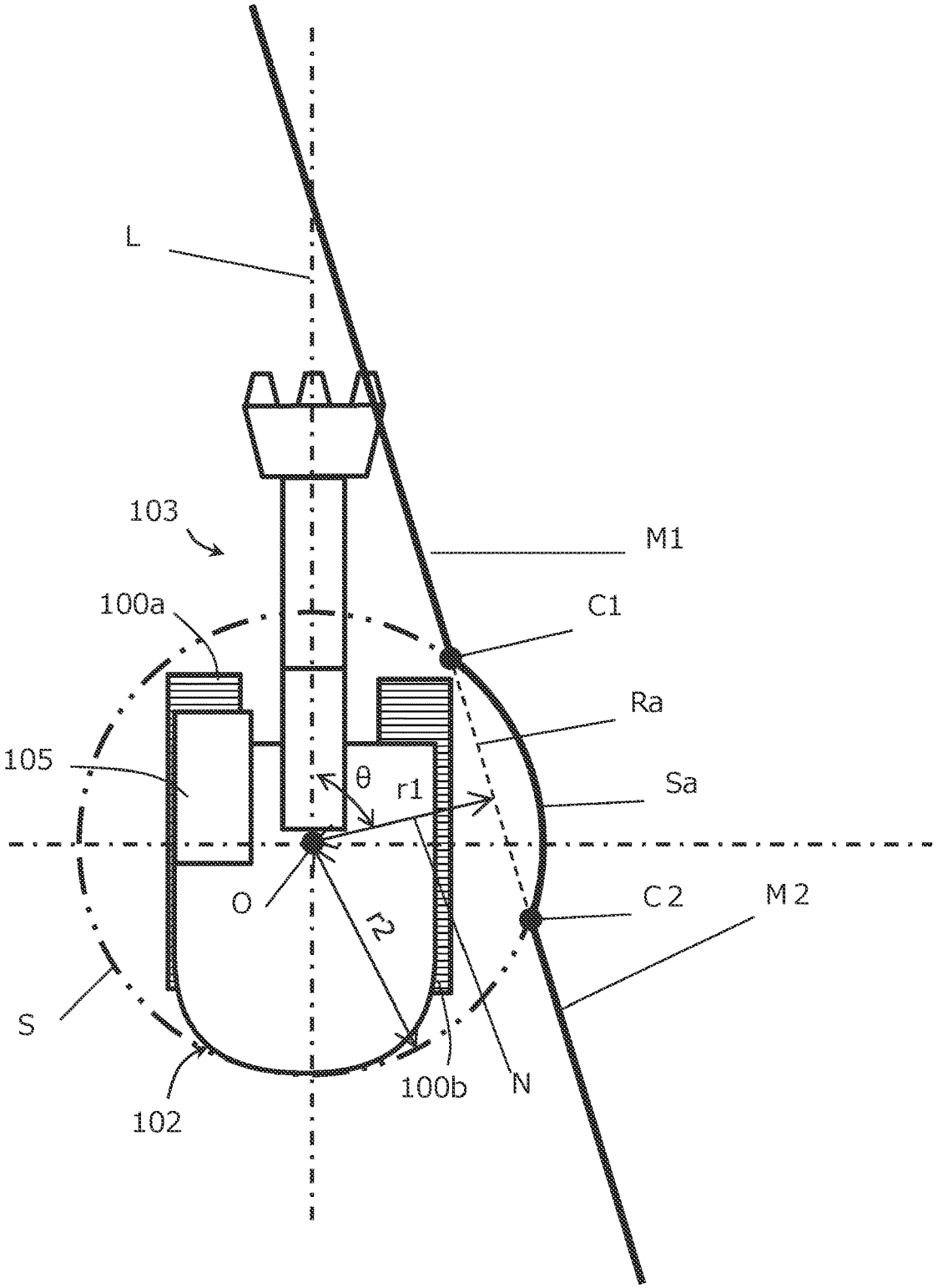
FIG. 11 is a diagrammatic view depicting a positional relation between an entry-prohibited area plane and the hydraulic excavator set by the main controller in the third embodiment.

FIG. 10 is a flow chart depicting a processing procedure for setting of an entry-prohibited area plane by the main controller 21 according to the present embodiment. FIG. 11 is a diagrammatic view depicting a positional relation between an entry-prohibited area plane set by the main controller 21 and the hydraulic excavator.

Referring to FIG. 10, in the present embodiment, the processing procedure in step S145 is different from the processing procedure in step S140 depicted in FIG. 8.

In particular, in the present embodiment, the main controller 21 is configured to set a corrected entry-prohibited area plane as the entry-prohibited area plane when, in step S115, the distance r1 between the target position M of the entry-prohibited area plane set by the console switch 11 (setting operation device) and the center O of swing action of the upper swing structure 102 is equal to or smaller than the threshold value r2 (step S145). The corrected entry-prohibited area plane in the present embodiment is an area plane determined by excluding a range inside the virtual circle S having a radius equal to the threshold value r2 from the entry-prohibited area plane when the entry-prohibited area plane is set at the target position M and replacing the excluded range with an arc of the virtual circle S.

More particularly, in step S145, the main controller 21 computes, positions of two intersection points C1 and C2 between the virtual circle S having a radius equal to the threshold value r2 and the entry-prohibited area plane, when the entry-prohibited area plane is set at the target position M, and then replaces the target position information of the range inside the two intersection points C1 and C2 of the entry-prohibited area plane (range inside the virtual circle S having a radius equal to the threshold value r2) Ra with position information of an arc Sa in the inside range Ra between the two intersection points C1 and C2 of the virtual circle S to set target positions M1, Sa and M2, and sets the corrected entry-prohibited area plane at the target positions M1, Sa, and M2.

Then, the main controller 21 controls the monitor 9 to display the target positions M1, Sa, and M2 as the corrected entry-prohibited area plane (step S150).

Also with the present embodiment, advantages similar to those of the second embodiment are obtained.

<Fourth Embodiment>

A fourth embodiment of the present invention is described with reference to FIG. 12.

Figure 12:
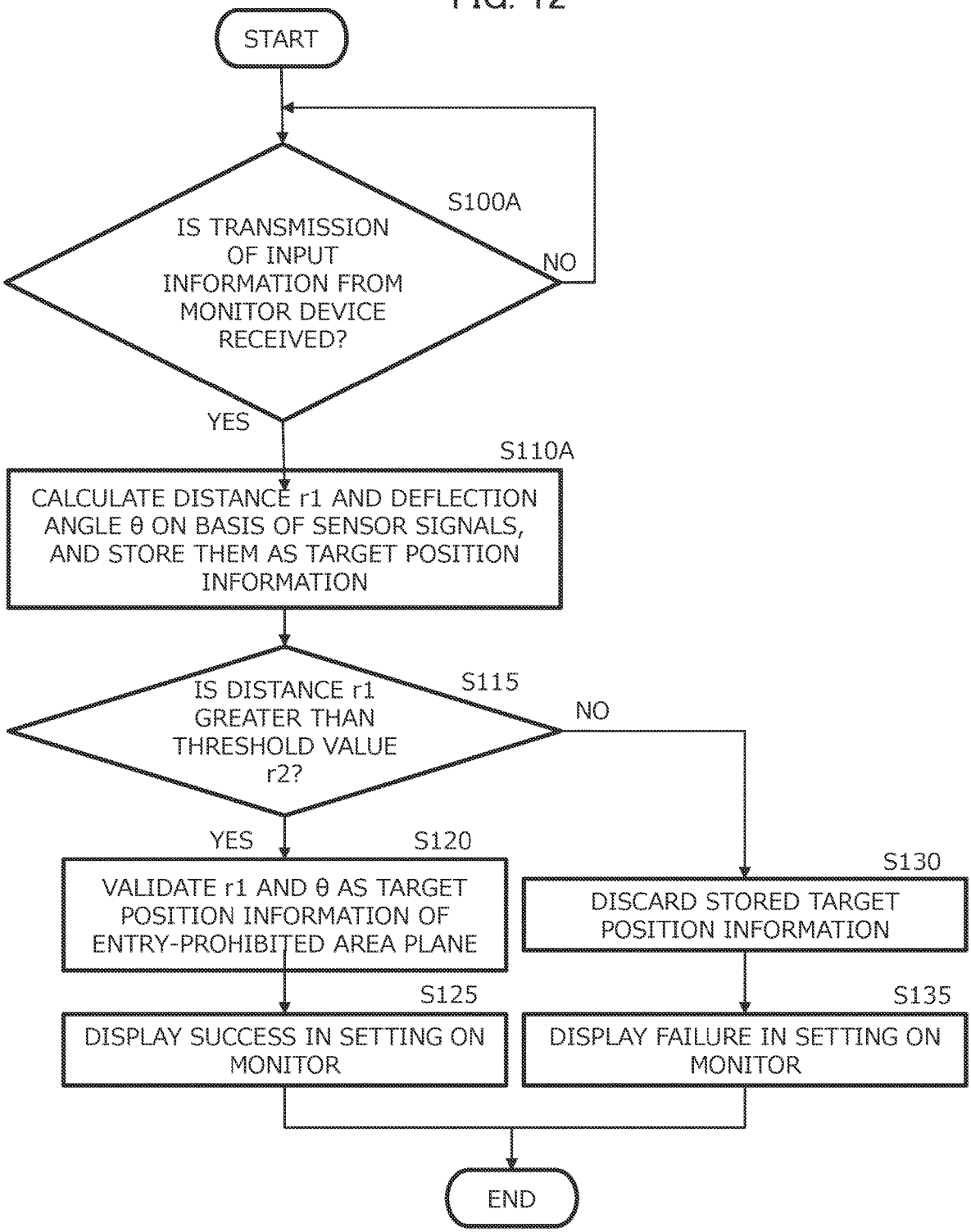
FIG. 12 is a flow chart depicting a processing procedure for setting of an entry-prohibited area plane by a main controller in a fourth embodiment of the present invention.

FIG. 12 is a flow chart depicting a processing procedure for setting of an entry-prohibited area plane by the main controller 21 according to the present embodiment.

The first to third embodiments use, as the target position instruction method for an entry-prohibited area plane, the method by positioning of the work implement 103 depicted in FIG. 5A or 5B. The present embodiment is directed to a case in which, as the target position instruction method for an entry-prohibited area plane, the method by numerical inputting with use of the monitor operation device 12 depicted in FIG. 5C, 5D, or 5E is used.

In the target position instruction method for an entry-prohibited area plane that uses the monitor operation device 12 depicted in FIG. 5C, 5D or 5E, input information transmitted from the monitor operation device 12 to the main controller 21 includes position information for computing a target position of an entry-prohibited area plane. Therefore, the processing procedure of the flow chart according to the present embodiment depicted in FIG. 12 does not include the processing procedure in step S105 in which sensor signals are received, which is included in the processing procedure of the flow chart depicted in FIG. 6 in the first embodiment.

Further, since not the console switch 11 but the monitor operation device 12 is used for instruction of a target position of an entry-prohibited area plane, the main controller 21 decides whether or not transmission of input information from the monitor operation device 12 is received (step S100A). When transmission of input information from the monitor operation device 12 is received, the main controller 21 computes a distance r1 from the center O of swing action of the upper swing structure 102 to an entry-prohibited area plane to be set and a deflection angle θ as the target position information of the entry-prohibited area plane, and stores the distance r1 and the deflection angle θ as target position information of the entry-prohibited area plane (step S110A).

The procedure after this is same as that of the flow chart depicted in FIG. 6 in the first embodiment.

Also with the present embodiment configured in such a manner as described above, advantages similar to those by the first embodiment can be obtained.

It is to be noted that, although, in the fourth embodiment, the procedure in steps S100 to S110 of the flow chart of the first embodiment depicted in FIG. 6 is altered to the procedure that uses position information by numerical inputting with use of the monitor operation device 12 depicted in FIG. 5C, 5D, or 5E, alternatively the procedure in steps S100 to S110 of the flow charts of the second and third embodiments depicted in FIGS. 8 and 10 may be altered to the procedure that uses position information by numerical inputting with use of the monitor operation device 12 depicted in FIG. 5C, 5D, or 5E. Also in this case, advantages similar to those by the third and second embodiments are obtained.

DESCRIPTION OF REFERENCE CHARACTERS

3, 4: Operation lever device
9: Monitor
10: Console box
11: Console switch
12: Monitor operation device
21: Main controller (controller)
22: Monitor controller
24: Angle sensor
25: Boom IMU sensor
26: Arm IMU sensor
27: Bucket IMU sensor
100: Lower track structure
102: Upper swing structure
103: Work implement
103*a*: Boom (front member)
103*b*: Arm (front member)
103*c*: Bucket (front member)
105: Cabin
M, M1, M2: Target position
r1: Distance
r2: Swing structure rear end radius (threshold value)
θ: Deflection angle
C1, C2: Intersection point
S: Virtual circle
Ra: Inner side range

The invention claimed is:

1. A work machine comprising:

a lower track structure;

an upper swing structure swingably mounted on an upper portion of the lower track structure;

a work implement attached pivotally in an upward and downward direction at a front portion of the upper swing structure; and a controller that performs area limiting control such that the work implement does not enter an entry-prohibited area beyond an entry-prohibited area plane set in advance, wherein the work machine further comprises a setting operation device provided within a cabin and used for setting a target position of the entry-prohibited area plane according to setting operation by an operator and a monitor, and wherein the controller is configured to:

when a distance between the target position set by the setting operation device and a center of swing action of the upper swing structure is greater than a threshold value set to a value equal to or greater than a distance from the center of swing action of the upper swing structure to a rear end of the upper swing structure:

set, as the entry-prohibited area plane, a plane perpendicular to a bottom plane of the lower track structure and passing through the target position set by the setting operation device, and control the monitor to display information of success in setting of the entry-prohibited area plane, and when the distance between the target position set by the setting operation device and the center of swing action of the upper swing structure is equal to or smaller than the threshold value:

discard the target position information without setting of the entry-prohibited area plane, and control the monitor to display information of failure in setting of the entry-prohibited area plane.

2. A work machine comprising:

a lower track structure;

an upper swing structure swingably mounted on an upper portion of the lower track structure;

a work implement attached pivotally in an upward and downward direction at a front portion of the upper swing structure; and a controller that performs area limiting control such that the work implement does not enter an entry-prohibited area beyond an entry-prohibited area plane set in advance, wherein the work machine further comprises a setting operation device provided within a cabin and used for setting a target position of the entry-prohibited area plane according to setting operation by an operator and a monitor; and wherein the controller is configured to:

when a distance between the target position set by the setting operation device and a center of swing action of the upper swing structure is greater than a threshold value set to a value equal to or greater than a distance from the center of swing action of the upper swing structure to a rear end of the upper swing structure:

set, as the entry-prohibited area plane, a plane perpendicular to a bottom plane of the lower track structure and passing through the target position set by the setting operation device, and control the monitor to display information of success in setting of the entry-prohibited area plane, and when the distance between the target position set by the setting operation device and the center of swing action of the upper swing structure is equal to or smaller than the threshold value:

set a corrected entry-prohibited area plane as the entry-prohibited area plane, and control the monitor to display the corrected entry-prohibited area plane, the corrected entry-prohibited area plane being an area plane determined by excluding a range inside a virtual circle having a radius equal to the threshold value and centered on the center of the swing action of the upper swing structure, from the entry-prohibited area plane set by the plane perpendicular to the bottom plane of the lower track structure and passing through the target position.

3. The work machine according to claim 1, wherein the work machine further comprises an angle sensor that senses a swing angle of the upper swing structure, and a plurality of posture sensors that are provided to the work implement and sense a posture of the work implement, and the controller is configured to compute the target position on a basis of signals from the angle sensor and the plurality of posture sensors when the setting operation device is operated.

4. The work machine according to claim 2, wherein the work machine further comprises an angle sensor that senses a swing angle of the upper swing structure, and a plurality of posture sensors that are provided to the work implement and sense a posture of the work implement, and the controller is configured to compute the target position on a basis of signals from the angle sensor and the plurality of posture sensors when the setting operation device is operated.

* * * * *